US007121531B1

(12) United States Patent
Gonzalez

(10) Patent No.: US 7,121,531 B1
(45) Date of Patent: Oct. 17, 2006

(54) GATE WITH LOCK HOUSING

(76) Inventor: Jesus Gonzalez, 12970 SW. 17 Ter., Miami, FL (US) 33175

( * ) Notice: Subject to any disclaimer, the term of this patent is extended or adjusted under 35 U.S.C. 154(b) by 112 days.

(21) Appl. No.: 11/015,637

(22) Filed: Dec. 20, 2004

(51) Int. Cl.
*E04H 17/16* (2006.01)

(52) U.S. Cl. ..... 256/73; 256/21; 49/394; 49/460; 70/416; 70/417

(58) Field of Classification Search ..... 70/416, 70/417, 418; 256/73, 21, 22; 49/394, 460; 292/337
See application file for complete search history.

(56) References Cited

U.S. PATENT DOCUMENTS 3,740,979 A * 6/1973 Crepinsek ..... 70/417
4,484,463 A * 11/1984 Hennessy ..... 70/417
4,565,079 A 1/1986 Smith
4,630,396 A 12/1986 Zvi et al.
5,620,216 A * 4/1997 Fuller ..... 292/337
5,787,741 A * 8/1998 Shen ..... 70/417
5,822,926 A * 10/1998 Koike et al. ..... 49/394

* cited by examiner

*Primary Examiner*—Daniel P. Stodola
*Assistant Examiner*—Michael P. Ferguson
(74) *Attorney, Agent, or Firm*—Sanchelima & Assoc., PA

(57) ABSTRACT

A gate assembly with moving gate members with one pivoting end and a moving end. This moving end includes upper and lower tubular members that receive the ends of a protruding reinforcement member mounted to a housing for the locking hardware. The ends of the protruding reinforcement member extend internally a sufficient distance to enhance the structural integrity of the moving end. The reinforcement member readily aligns the housing with the tubular members of the moving end and provides a sturdy structure that is tamper proof. Through openings in the walls of the housing cooperate to permit the operation of the locking hardware.

3 Claims, 3 Drawing Sheets

Fig 1
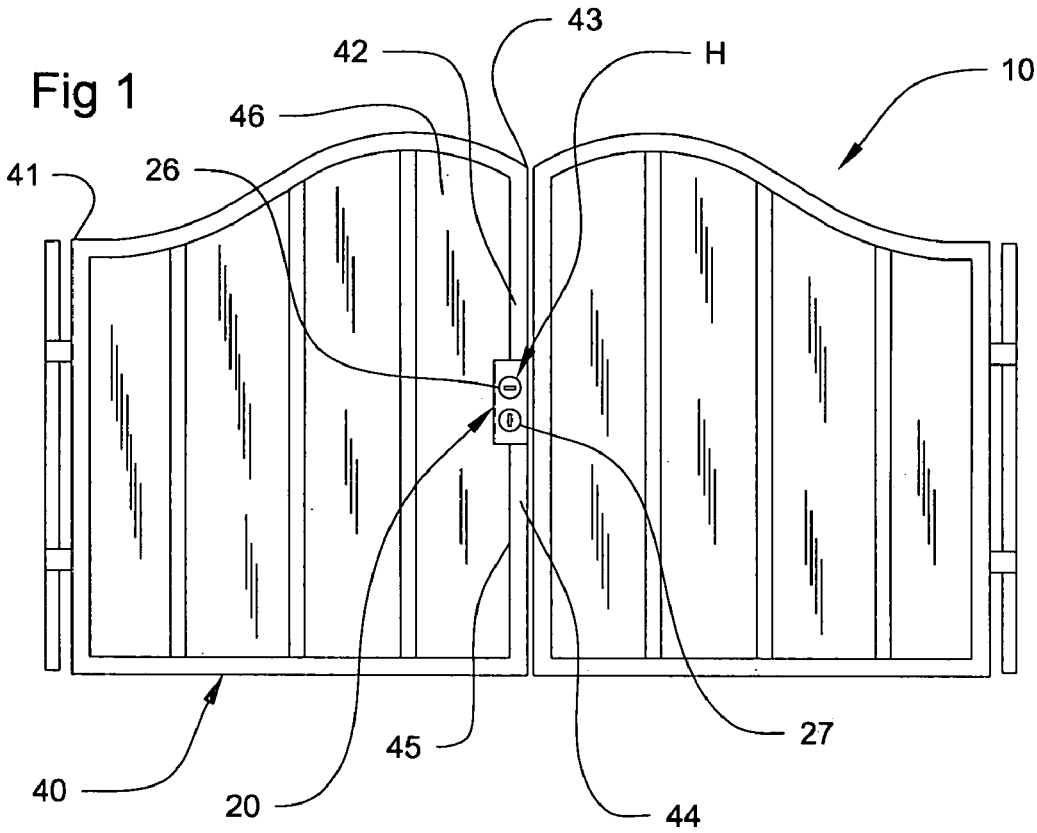
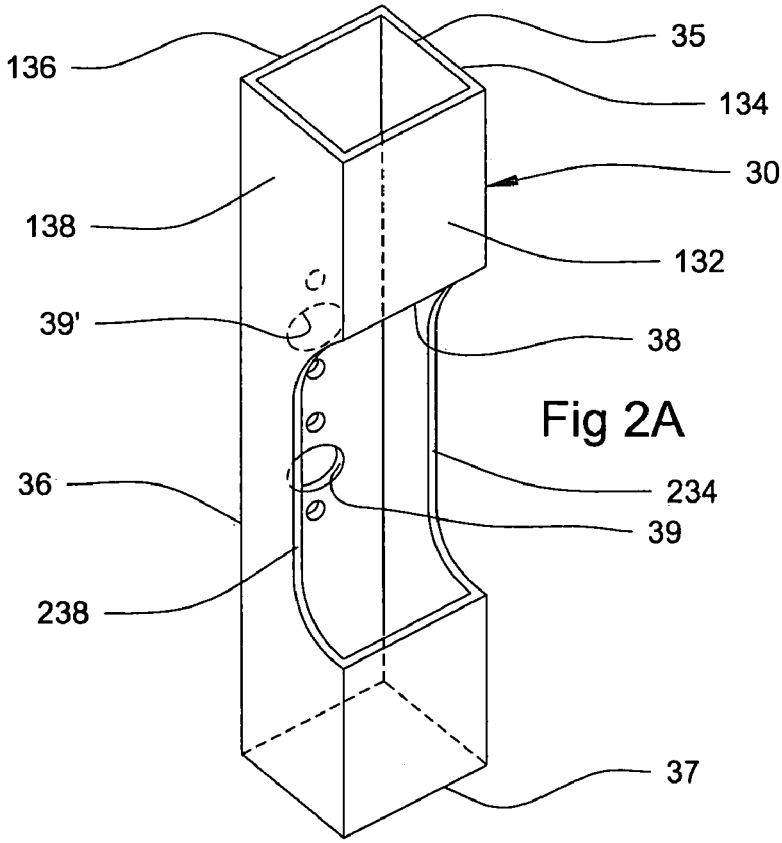
Fig 2A

GATE WITH LOCK HOUSING

BACKGROUND OF THE INVENTION

1. Field of the Invention

The present invention relates to a metal gate with a lock housing, and more particularly, to such a gate that is hingedly mounted to a fixed location.

2. Description of the Related Art

Many or most designs for gates with lock housing are built on site to accommodate the locking hardware. None of these gates, however, includes a lock housing that can be readily mounted to the gate also reinforcing the resulting assembly.

A gate has a moving end and a pivoting end. The moving end of the gate includes the locking hardware and typically the moving end needs to be modified. Adaptation and last minute innovation is required to install the hardware in most instances. These operations include cutting the distal post member of the gate compromising the structural integrity and strength of the gate. A housing is subsequently welded to the ends of the severed distal post member.

Applicant believes that the closest reference corresponds to U.S. Pat. No. 4,565,079 issued to Smith on Jan. 21, 1986 for a deadbolt gate lock. Smith's deadbolt gate lock includes a casing with a through slot. Smith's patented invention also includes spacer blocks within the casing with aligned bores to receive the deadbolt and an access opening. However, it differs from the present invention because it fails to show an integral reinforcement member as described and claimed in the present invention. The member reinforces the gate where the locking hardware is installed. Also, the member doubles as a guide for proper installation of the housing. Additionally, the protruding lateral edges that give structural rigidity and facilitate the installation of decoration panels on the gate are not disclosed in this reference. These elements combined provide a sturdier and more useful structure that can be readily installed.

Applicant believes that another related reference corresponds to U.S. Pat. No. 4,630,396 issued to Zvi, et al. on Dec. 23, 1986 for a security gate apparatus. Zvi's patented invention comprises a security gate including gate-carried locking means intended to make it difficult to open the security gate from without the building opening. Again, it does not teach the use of a reinforcement member that doubles as a guiding member.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a gate with lock housing that can be readily assembled permitting the installation of suitable locking hardware.

It is another object of this invention to provide a gate that reinforces the structural integrity of the gate where the lock housing is installed.

It is still another object of this invention to provide a gate with a lock housing that is tamper resistant.

It is yet another object of this invention to provide such a gate that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents a front elevational view of the gate with a lock housing object of the present application.

FIG. 2A shows an isometric enlarged view of the reinforcement member used in the embodiment described in the specifications.

DETAILED DESCRIPTION OF THE PREFERRED EMBODIMENT

Figure 2:
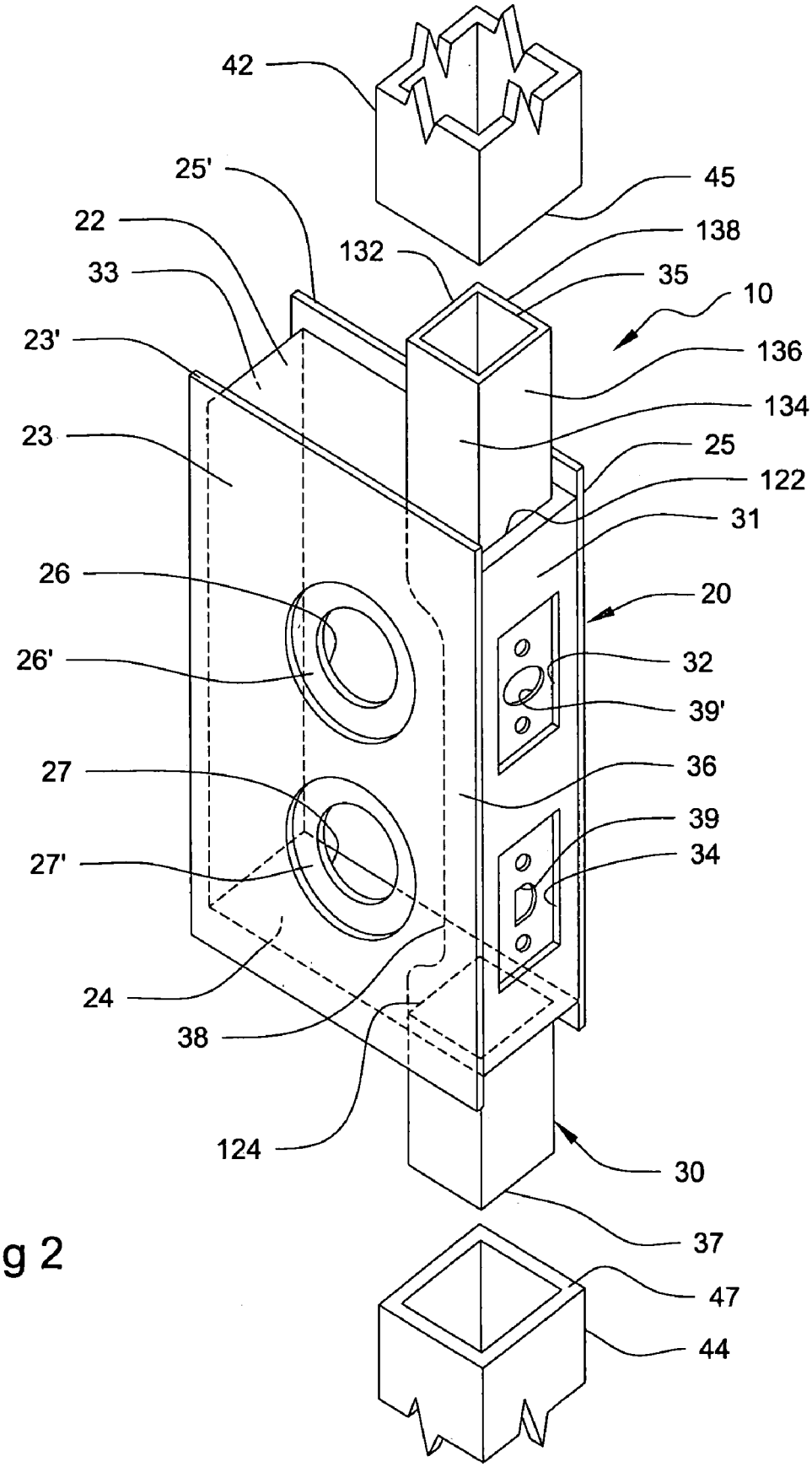
FIG. 2 shows an isometric enlarged view of the housing for preferred embodiment for lock hardware object of the present application using two locking hardware assemblies.

Referring now to the drawings, where the present invention is generally referred to with numeral 10, it can be observed that it basically includes lock housing 20 and gate frame assembly 40. FIG. 1 shows an installation of one of the preferred embodiments of the present invention in a typical gate with two typical locking hardware assemblies M.

Figure 3:
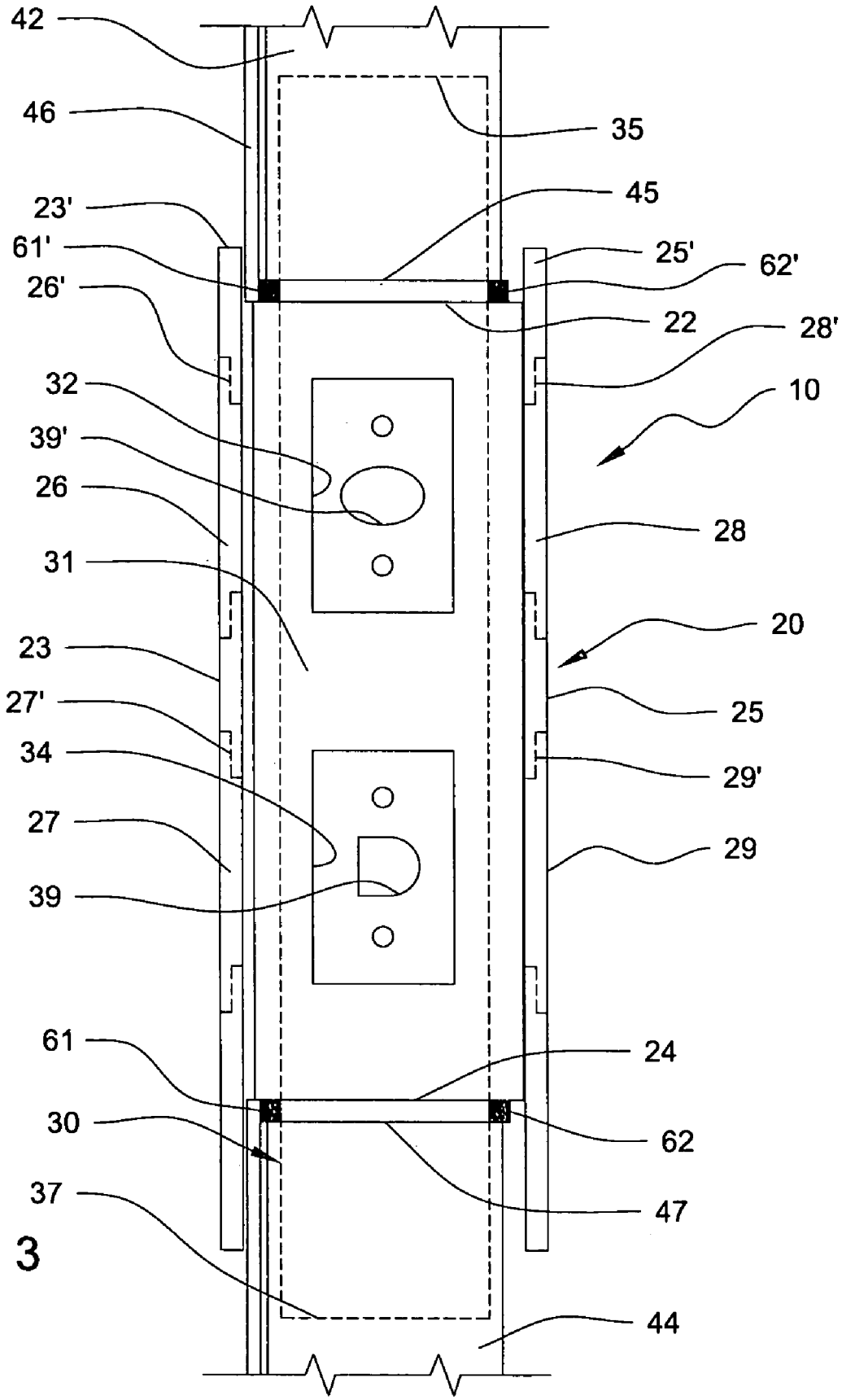
FIG. 3 illustrates a side elevational view of the housing for lock hardware shown in FIG. 2.

As seen in FIGS. 2 and 3, housing assembly 20 includes upper and lower walls 22 and 24 with upper and lower through openings 122 and 124, respectively, front wall 23, rear wall 25 and lateral walls 31 and 33. Front wall 23 includes through opening 26 with recessed counterbore 26' and through opening 27 with recessed counterbore 27'. In the same way rear wall 25 includes through opening 28 with recessed counterbore 28' and through opening 29 with recessed counterbore 29'. Lateral wall 31 includes substantially rectangular through openings 32 and 34. Front and rear walls 23 and 25 have protruding edges 23' and 25' extending outwardly beyond walls 22, 24 and 33. Reinforcement member 30 is rigidly secured within housing assembly 20 and protruding beyond upper and lower walls 22 and 24.

As best seen in FIG. 2A, reinforcement member 30 is an elongated tubular member with a substantially square cross section. Opposite walls 132 and 136 and opposite walls 134 and 138. Also, reinforcement member 30 includes upper and lower ends 35 and 37, respectively. Central portion 36 includes through aperture 38, which is an interruption of wall 132 and partially interrupting walls 134 and 138 to define cutouts 234 and 238, respectively. Through aperture 38 provides space for lock hardware H be partially housed within central portion 36. Additionally, central portion 36 includes through openings 39 and 39' on wall 136 for elements of lock hardware H to go through.

As shown in FIG. 1, gate 40 has pivoting end 41 and a moving end 43. Moving end 43 includes upper and lower tubular members 42 and 44 with distal ends 45 and 47, respectively. As best seen in FIG. 3, upper and lower ends 35 and 37 of reinforcement member 30 are cooperatively received through the distal ends of upper and lower tubular members 42 and 44, respectively. Ends 35 and 37 of reinforcement member 30 are received by distal ends 45 and 47, respectively, and extend a predetermined distance within tubular members 42 and 44 to ensure the integrity of the structure is enhanced. Welding points 61; 61'; 62 and 62' further secure lock housing 20 in place.

Optionally, panel 46 may be mounted to lateral wall 33, top wall 22 and bottom 24 so protruding edges 23' and 25' cooperatively cover welding points 61; 61'; 62 and 62'.

Locking hardware assembly M is mounted within lock housing 20 and the former is operable through front and rear through openings 26; 27; 28 and 29 and lateral through openings 32 and 34.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A gate assembly with a lock housing including:

A) a gate member having a pivoting end and a moving end, said moving end including a vertical tubular member interrupted by a predetermined distance thereby defining an upper tubular member having a first distal end and a lower tubular member having a second distal end;

B) a housing including upper and lower walls having upper and lower through openings, respectively, and further including front and rear walls, spaced apart with respect to each other, and said front and rear walls including front and rear through openings, respectively, and said housing further includes first and second lateral walls, spaced apart with respect to each other, said first lateral wall including a lateral through opening and said lateral walls defining a space within said housing;

C) an elongated reinforcement tubular member having first and second ends and a substantially rectangular cross-section, wherein said elongated reinforcement tubular member includes first, second, third and fourth elongated walls, adjacent elongated walls being perpendicularly disposed with respect to each other defining the substantially rectangular cross section, said first elongated wall including a first through aperture, said second and third elongated walls each include longitudinal cutouts that extend from said first through aperture and said fourth elongated wall includes a second through aperture in substantial alignment with said first through aperture, and said fourth elongated wall being rigidly mounted to said first lateral wall of said housing with said first and second ends protruding out through said upper and lower through openings, respectively, and said first and second ends being received and housed by said first and second distal ends of said upper and lower tubular members; and D) locking hardware mounted within said housing and operable through said front and rear through openings and said lateral through opening.

2. The gate assembly set forth in claim 1, having at least one additional set of front and rear through openings in said front and rear walls of said housing and at least one additional lateral through opening in said first lateral wall for cooperatively permitting the use of at least one additional locking hardware.

3. The gate assembly set forth in claim 2 wherein said front and rear walls of said housing extend a predetermined distance beyond the position of said upper and lower walls and said second lateral wall to provide a flanged surface for supporting and keeping in place a flat panel insertable adjacent to said flanged surface and said first and second distal ends of said upper and lower tubular members.

* * * * *